US005579735A

United States Patent [19]

Todero et al.

[11] Patent Number: 5,579,735

[45] **Date of Patent: *Dec. 3, 1996**

[54] FOUR-STROKE INTERNAL COMBUSTION ENGINE

[75] Inventors: Giuseppe P. I. Todero, Mandello del Lario, Italy; Rodney L. Harms, Tucson, Ariz.

[73] Assignee: McCulloch Corporation, Tucson, Ariz.

[ * ] Notice: The term of this patent shall not extend beyond the expiration date of Pat. No. 5,347,967.

[21] Appl. No.: 219,164

[22] Filed: Apr. 1, 1994

Related U.S. Application Data

[63] Continuation-in-part of Ser. No. 82,677, Jun. 25, 1993.

[51] Int. Cl.[6] ..... F02B 75/02

[52] U.S. Cl. ..... 123/317; 123/90.38

[58] Field of Search ..... 123/317, 45 VB, 123/73 A, 90.38, 90.33

[56] References Cited

U.S. PATENT DOCUMENTS

| | | |
|---|---|---|
| 349,983 | 9/1886 | Daimler . |
| 683,152 | 9/1901 | St. John . |
| 779,778 | 1/1905 | Hagar . |
| 931,976 | 8/1909 | Turner . |
| 1,038,830 | 9/1912 | Bellem et al. . |
| 1,077,363 | 11/1912 | Nash . |
| 1,090,991 | 3/1914 | Knight . |
| 1,120,248 | 12/1914 | Shakley . |

(List continued on next page.)

FOREIGN PATENT DOCUMENTS

| | | |
|---|---|---|
| 1255607 | 6/1989 | Canada . |
| 2519695 | 7/1983 | France . |
| 2411513 | 9/1975 | Germany . |
| 3314721 | 10/1984 | Germany . |
| 474143 | 9/1952 | Italy . |
| 51-149408 | 12/1976 | Japan . |
| 0085320 | 5/1983 | Japan ..... 123/317 |
| 59-77036 | 5/1984 | Japan . |
| 59-229017 | 12/1984 | Japan . |
| 61-49130 | 3/1986 | Japan . |
| 62-17320 | 1/1987 | Japan . |
| 62-35027 | 2/1987 | Japan . |
| 248605 | 2/1948 | Switzerland . |
| 30475 | 8/1910 | United Kingdom . |

OTHER PUBLICATIONS

Article "Engine Review" from Model Airplane News (Author Peter Chinn), dated May, 1981 (pp. 32–34; 90–91).

Article, "New Environmental Technology Developed for Portable Lawn & Garden Engines" from Ryobi News (Publisher Ryobi America Corporation, dated Nov. 17, 1992 (pp. 1–19).

(List continued on next page.)

*Primary Examiner*—Marguerite McMahon

*Attorney, Agent, or Firm*—Marshall, O'Toole, Gerstein, Murray & Borun

[57] ABSTRACT

A four-stroke engine comprising an engine frame including a block and a head, the block forming at least one cylinder and a crankcase. A piston is mounted for reciprocation in the cylinder, and a crank and connecting rod are mounted in the crankcase and connected to the piston. The crankcase includes a fuel inlet port and an outlet port, and a duct connects the outlet port to an intake passage in the head. The inlet port is connected to a supply of a combustible mixture comprising fuel, lubricating oil and air. During engine operation, the mixture flows through the crankcase, the duct, and the air intake passage to the cylinder. Valves and valve actuating mechanisms control the flow of the mixture to the cylinder and the flow of exhaust from the cylinder. The oil in the mixture lubricates the engine parts in the crankcase, the valves and the valve actuating mechanisms. The duct preferably forms a plenum or surge tank containing the mixture under pressure. The engine may include more than one cylinder and piston, such as a two-cylinder engine having pistons which move in synchronism to produce crankcase compression.

22 Claims, 7 Drawing Sheets

U.S. PATENT DOCUMENTS

| | | | |
|---|---|---|---|
| 1,165,135 | 12/1915 | Seitz . | |
| 1,319,757 | 10/1919 | Chorlton . | |
| 1,366,530 | 1/1921 | Gage . | |
| 1,396,418 | 11/1921 | Gilliard . | |
| 1,599,878 | 9/1926 | Dickey et al. . | |
| 1,762,214 | 6/1930 | Cartwright | 123/65 VB |
| 1,803,326 | 5/1931 | Gernandt . | |
| 1,812,566 | 6/1931 | Spencer . | |
| 1,875,149 | 8/1932 | Reid . | |
| 1,981,610 | 11/1934 | Bucklen . | |
| 2,067,715 | 1/1937 | Kylen . | |
| 2,256,437 | 9/1941 | Kylen | 123/73 AB |
| 3,418,993 | 12/1968 | Scheiterlein et al. . | |
| 3,499,425 | 3/1970 | Gommel . | |
| 3,561,416 | 3/1970 | Kiekhaefer . | |
| 3,672,172 | 6/1972 | Hammond | 123/317 |
| 3,739,809 | 6/1973 | Ulbing . | |
| 3,756,206 | 9/1973 | Gommel . | |
| 3,823,697 | 7/1974 | Von Esch . | |
| 3,852,204 | 12/1974 | Soulliard et al. . | |
| 3,859,968 | 1/1975 | Stinebaugh | 123/73 V |
| 3,973,532 | 8/1976 | Litz . | |
| 4,038,954 | 8/1977 | Franke . | |
| 4,380,216 | 4/1983 | Kandler | 123/90.65 |
| 4,388,898 | 6/1983 | Larson | 123/90.38 |
| 4,461,251 | 7/1984 | Sheaffer | 123/317 |
| 4,475,499 | 10/1984 | Sheaffer | 123/317 |
| 4,538,567 | 9/1985 | Grow | 123/317 |
| 4,545,346 | 10/1985 | Grow | 123/317 |
| 4,558,671 | 12/1985 | Stinebaugh | 123/317 |
| 4,601,267 | 7/1986 | Kronich | 123/41.86 |
| 4,662,322 | 5/1987 | Tamba et al. | 123/41.86 |
| 4,708,107 | 11/1987 | Stinebaugh | 123/317 |
| 4,766,859 | 8/1988 | Miyaki et al. | 123/196 W |
| 4,779,579 | 10/1988 | Sukava et al. . | |
| 4,784,095 | 11/1988 | Golding et al. | 123/90.33 |
| 5,005,537 | 4/1991 | Maissant | 123/65 VB |
| 5,103,777 | 4/1992 | Dalkoku | 123/52 MB |
| 5,176,116 | 1/1993 | Imagawa et al. | 123/196 W |
| 5,178,104 | 1/1993 | Ito et al. | 123/73 A |

OTHER PUBLICATIONS

SAE Technical Paper Series 840423–Torque Boosting of 4–Stroke Cycle etc.–N. Okanishi et al.–Feb. 27, 1984.

SAE Technical Paper Series 940840, N. Okanishi et al., titled "Application of Crankcase–Supercharging to a 4–Stroke Cycle Compression Ignition Engine", dated Feb. 28–Mar. 3, 1994.

SAE Technical Paper Series 940841, N. Okanishi et al., titled "On–Road Tests Using Small Crankcase–Supercharged 4–Stroke Cycle Engines", dated Feb. 28–Mar. 3, 1994.

FOUR-STROKE INTERNAL COMBUSTION ENGINE

RELATED PATENT APPLICATIONS

This application is a continuation-in-part of patent application Ser. No. 08/082,677, filed Jun. 25, 1993 and titled "Four-Stroke Internal Combustion Engine".

FIELD AND BACKGROUND OF THE INVENTION

This invention relates to an internal combustion (IC) engine, and more particularly to an IC engine particularly suited for use in hand-held (portable) tools.

Relatively small size IC engines are well known and are commonly used to power tools such as chain saws, blowers, line trimmers, etc. Since such tools are normally carried and used by a single person, the engine must be light weight and capable of operation in different orientations (sideways or straight up, for example).

At the present time, most engines for this purpose are two-stroke air-cooled engines because they have a good power vs. weight and size ratios, do not have a complex construction, and they are all position or orientation engines. The latter feature is made possible because such engines utilize a diaphragm-type carburetor and engine lubrication is accomplished by adding lubrication oil to the fuel (typically a 40:1 fuel-to-oil mixture).

While two-stroke engines of this type work well, they have certain drawbacks. The fuel consumption rate is relatively high and the operating noise level is also high. A very important disadvantage is that the emissions levels of such engines are quite high because the exhaust includes a sizable amount of fresh fuel. The State of California regulations soon to become effective limit the amounts of hydrocarbons and carbon monoxide that may be produced, and most or all two-stroke engines presently in use will not be able to meet the California standards. It is expected that those standards will also be adopted by other states and countries.

Four-stroke IC engines are, of course, also well known and they generally have lower hydrocarbon and carbon monoxide emissions than two-stroke engines. This is true because four-stroke engines exchange the exhaust and fresh fuel/air mixture in a more positive manner with the use of valves. Four-stroke engines also in general have lower noise levels.

Relatively small four-stroke engines are available and have been used in, for example, model or hobby aircraft. While such engines are sufficiently small to be used in portable tools, they would not be satisfactory because they have a relatively complex and light duty construction. Four-stroke engines normally have an oil sump in a crankcase at the bottom of the engine and an oil pump for moving the oil to the moving parts such as the overhead valves and the valve actuating mechanisms. This type of lubricating system is not satisfactory for all-position use.

In addition, the Y. Imagawa et al. U.S. Pat. Nos. 5,176,116, dated Jan. 5, 1993, and U.S. Pat. No. 5,213,074, dated May 25, 1993 describe a lubrication system for a portable four-stroke engine, wherein some of the engine parts are lubricated by oil in a crankcase and other parts by grease which is packed around moving parts. It is questionable whether grease will provide satisfactory lubrication for engine parts that become very hot during use. In any event it is doubtful that grease is satisfactory for long-term use in an engine in field and garden use because the grease should be periodically cleaned out and repacked. This is not practical in engines used, for example, in home gardening tools.

The R. G. Everts U.S. Pat. No. 5,241,932 dated Sep. 7, 1993, and the Y. Imagawa et al. U.S. Pat. No. 5,267,536 dated Dec. 7, 1993, describe engines generally similar to the engine described in U.S. Pat. No. 5,213,074. Both patents describe lubrication systems for a four-stroke engine, including oil in a crankcase sump and a splasher. U.S. Pat. No. 5,241,932 also states that "mist ladened air" moves from the crankcase through the valve guide tubes to the valve cover, to lubricate the valves and the rocker arms.

The D. E. Stinebaugh U.S. Pat. No. 4,708,107, dated Nov. 24, 1987, describes a four-stroke engine including a crankcase-compression arrangement. A carburetor supplies a "combustible working fluid such as an air-gasoline mixture" to the crankcase, and the mixture is pumped through a "boost plenum or reservoir", through a throttle valve, to the cylinder intake valve. A cam shaft and cam followers for the intake and exhaust valves are mounted in the boost plenum.

It is therefore a general object of the present invention to provide an improved four-stroke engine.

SUMMARY OF THE INVENTION

An engine constructed in accordance with this invention comprises an engine frame including a block portion and a head portion, the block portion forming at least one cylindrical cylinder and a crankcase. A piston is mounted for reciprocation in the cylinder, and a crank and connecting rod are mounted in the crankcase and connected to the piston. The head portion forms one end of the cylinder and the piston forms the other end, and the intake air and the exhaust flow through intake and exhaust passages formed in the head portion. The crankcase includes a fuel inlet port and an outlet port, and a duct connects the outlet port to the intake passage in the head portion. The inlet port is connected to a supply of a combustible mixture comprising fuel, lubricating oil and air.

During engine operation, the mixture flows through the crankcase from the fuel inlet port to the outlet port, the piston functioning as a pump to move the mixture. The oil in the mixture lubricates the engine parts in the crankcase. From the outlet port, the mixture, including the lubricating oil, moves along a flow path through the duct to the intake passage in the head portion. The valves and the valve actuating mechanism are located such that they are lubricated by the combustible mixture. Thus the moving parts of the engine are lubricated by the oil in the mixture which is continuously replenished and flows around the moving parts during engine operation.

Valves may be provided at the fuel inlet and outlet ports of the crankcase to achieve crankcase compression of the mixture, and the duct may form a plenum or reservoir of the mixture under pressure. The engine may include more than one cylinder and piston, such as a two-cylinder engine (or an engine having multiples of two cylinders) having two pistons which simultaneously move toward the crankcase or the cylinder heads.

The valves and the valve actuating mechanisms are located in the mixture flow path to be lubricated by the mixture. The actuating mechanism may be located in the head portion of the engine or they may be located in the crankcase.

BRIEF DESCRIPTION OF THE DRAWINGS

This invention may be better understood from the following detailed description taken in conjunction with the accompanying figures of the drawings wherein.

DETAILED DESCRIPTION OF THE DRAWINGS

Figure 1A:
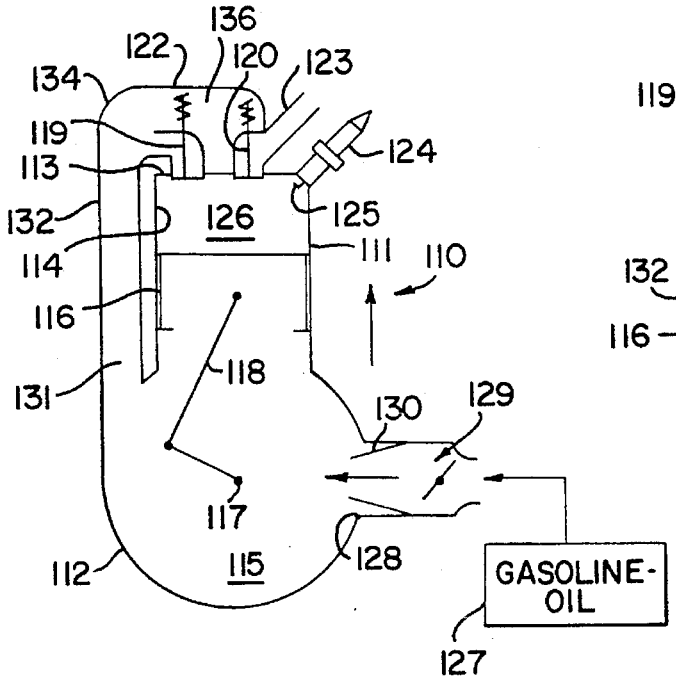
FIGS. 1A through 1D are schematic views illustrating the four operating strokes of an engine incorporating the present invention.
Figure 1B:
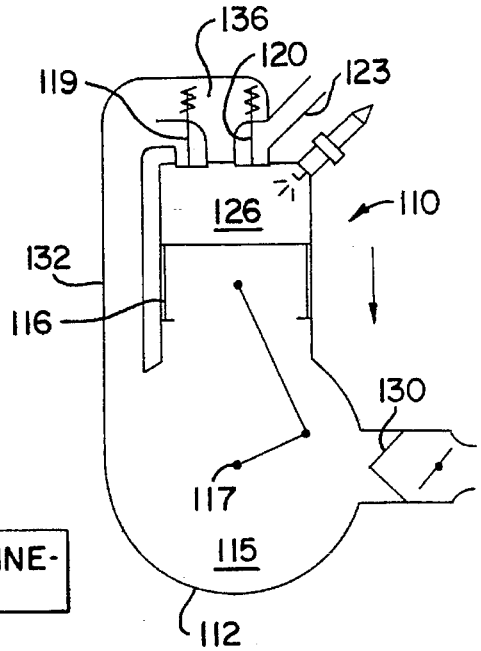
Figure 1C:
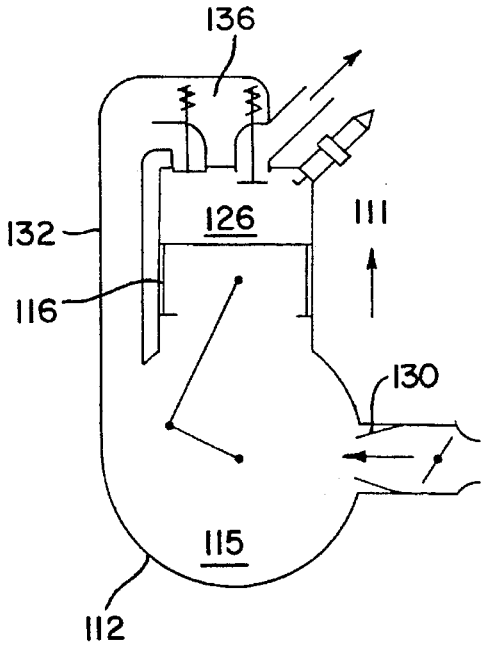
Figure 1D:
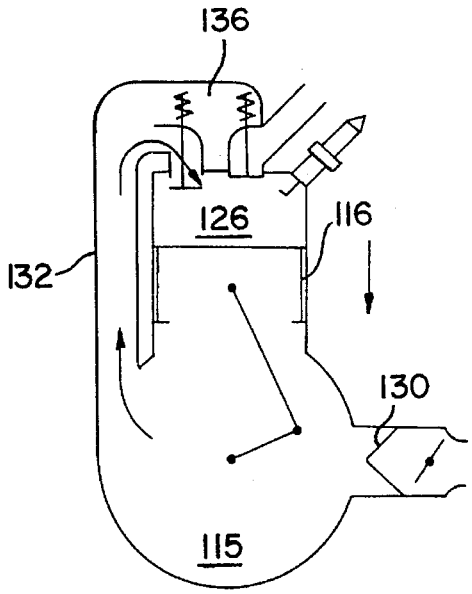

FIGS. 1A through 1D illustrate a four-stroke overhead valve internal combustion engine 110, wherein FIG. 1A shows the compression stroke, FIG. 1B shows the expansion or power stroke, FIG. 1C shows the exhaust stroke, and FIG. 1D shows the intake stroke. The engine includes a frame including a block portion 111, a crankcase portion 112, and a head portion 113. The block portion 111 forms a cylinder 114 and a piston 116 is reciprocally mounted in the cylinder 114. A crank shaft 117 is rotatably mounted in the block portion 111 and a connecting rod 118 connects the piston 116 to the shaft 117. Mounted on the head portion 113 are an intake valve 119 and an exhaust valve 120 which are enclosed by a valve cover 122. An exhaust duct 123 surrounds the exhaust valve 120 and conveys exhaust from the cylinder 114 to a muffler (not illustrated). Also mounted on the head portion 113 is a spark plug 124 which has its points 125 extending into a combustion chamber 126 formed between the crown of the piston 116, the side walls of the cylinder 114 and the head portion 113.

A fuel inlet port 128 is formed in the side wall of the crankcase 112 and, during engine operation, receives a combustible mixture from a carburetor indicated by the reference numeral 129. The carburetor 129 is preferably an all-position type such as a diaphragm carburetor. A one-way or check valve 130 is connected across the inlet port 128 and allows the mixture to flow only in the direction from the carburetor 129 to the interior chamber 115 of the crankcase 112. The intake side of the carburetor 129 is connected to a supply tank 127 of a fuel-oil mixture such as a 40-1 mix of gasoline and oil. The oil may be the type commonly used with small two-stroke engines. The gas-oil mixture is further mixed with air in the carburetor 129 to form the previously mentioned combustible mixture that flows from the carburetor 129 into the crankcase chamber 115.

The crankcase 112 also has an outlet port 131 formed therein, and a duct 132 has one end thereof connected to the outlet port 131 of the crankcase 112 and its other end 134 connected to an enclosure 136 formed in the head portion 113 and the cover 122. The duct 132 thus conveys the mixture from the chamber 115 of the crankcase 112 to the enclosure 136 within the cover 122. Also included in the engine but not illustrated in FIGS. 1A to 1D are valve operating or actuating mechanisms, located within the flow of the mixture such that the mechanisms are lubricated. For example, the valves and the valve actuating mechanisms of all of the embodiments disclosed herein may include a cam and push rod arrangement for driving rocker arms that operate the valves, the cam and push rods being located in the chamber 115 and/or in the duct 132, and the rocker arms being located in the enclosure 136. Alternatively, a timing belt may be connected between the crankshaft 117 and a cam mechanism mounted in the enclosure 136 as illustrated in FIGS. 5A and 5B. Still another arrangement is shown in FIG. 6 wherein the cam shaft, push rods and valves are mounted in a chamber formed in the block portion, in flow communication with the crankcase. The valves and valve actuating mechanisms of the engines shown in FIGS. 2A to 2D, FIGS. 3A to 3B and FIGS. 4A to 4B may also be one of the foregoing types.

Considering the operation of the engine, during the compression stroke illustrated in FIG. 1A, the two valves 119 and 120 are closed and the piston 116 moves toward the head portion 113, thereby compressing the mixture within the combustion chamber 126. As the piston 116 moves upwardly, it increases the interior space or volume of the crankcase chamber 115 formed by the crankcase 112 and the underside of the piston 116, thereby drawing the combustible mixture through the inlet port 128 from the carburetor 129. The check valve 130, of course, opens as illustrated in FIG. 1A to allow flow in this direction. Near the end of the compression stroke, the spark plug 124 fires and ignites the combustible mixture in the chamber 126, thereby driving the piston 116 in the downward direction as seen in FIG. 1B, the two valves 119 and 120 being closed. Since the piston 116 moves downwardly, it reduces the volume of the chamber 115 within the crankcase 112, thereby increasing the pressure of the mixture within the chamber 115. This action closes the valve 130 and compresses the combustible mixture within the chamber 115, the duct 132 and the enclosure 136.

At the end of the power stroke shown in FIG. 1B, the piston 116 moves upwardly again in the exhaust stroke as illustrated in FIG. 1C, and at this time the valve actuating mechanism opens the exhaust valve 120. Cylinder exhaust gases from the previous power stroke are purged from the combustion chamber 126 by the upward movement of the piston 116 which pushes them out of the combustion chamber 126 through the open exhaust valve 120 and the exhaust duct 123.

At the end of the exhaust stroke, the piston 116 again moves downwardly in the fuel intake stroke as shown in FIG. 1D. The exhaust valve 120 is closed and the intake valve 119 is opened by the valve actuating mechanism. The downward movement of the piston 116 sucks the mixture into the combustion chamber 126 and pushes the mixture from the crankcase chamber 115 through the duct 132, through the open intake valve 119 and into the combustion chamber 126. The intake valve 119 closes at the end of the intake stroke of the piston 116, and the piston then starts upwardly again in the next compression stroke (FIG. 1A), thereby completing one operating cycle of the engine.

It will be apparent from the foregoing that the combustible mixture from the carburetor 129 flows through the crankcase 112 and through the valve cover 122, and the mixture contacts all of the moving parts requiring lubrication. The mixture forms an oil mist in the crankcase chamber 115 and in the cover 122 which is continuously replenished as the mixture flows around the parts to the intake valve, the parts being in the flow path. The enclosure 136 around the valves and the valve actuating mechanism and the crankcase contain a quantity of an oily mist which lubricates the parts. Some of the oil in the mist settles on the moving parts and clings thereto, thereby providing continuous lubrication for these parts.

The engine 210 illustrated in FIGS. 2A through 2D is generally similar to the engine shown in FIGS. 1A through 1D, and the same reference numerals for corresponding parts are employed except that in FIGS. 2A through 2D the numerals are in a 200 series rather than in the 100 series of FIGS. 1A to 1D.

The engine 210 shown in FIGS. 2A to 2D includes a duct 232 connecting the crankcase 212 with the valve cover 222. The duct 232 includes an enlarged portion 240, whereby the duct 232 forms a storage plenum or surge tank. The engine 210 further includes a one-way or check valve 241 extending across the outlet port 231 of the crankcase 212. As illustrated, the valve 241 permits flow of the combustible mixture only in the direction from the crankcase chamber 115 to the plenum 240.

Figure 2A:
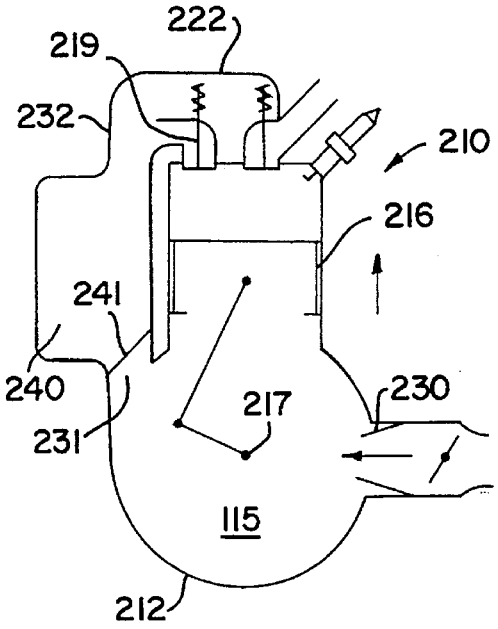
FIGS. 2A through 2D are views similar to FIGS. 1A through 1D but illustrate an alternative construction of the engine.
Figure 2B:
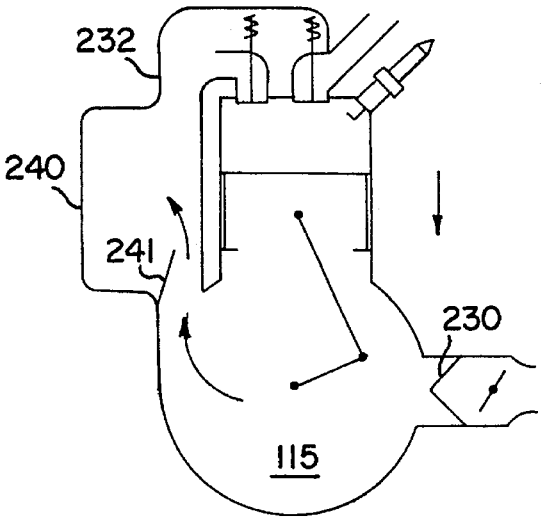
Figure 2C:
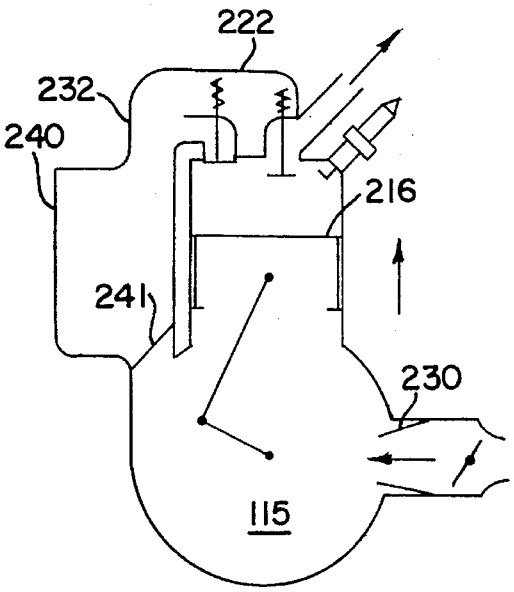
Figure 2D:
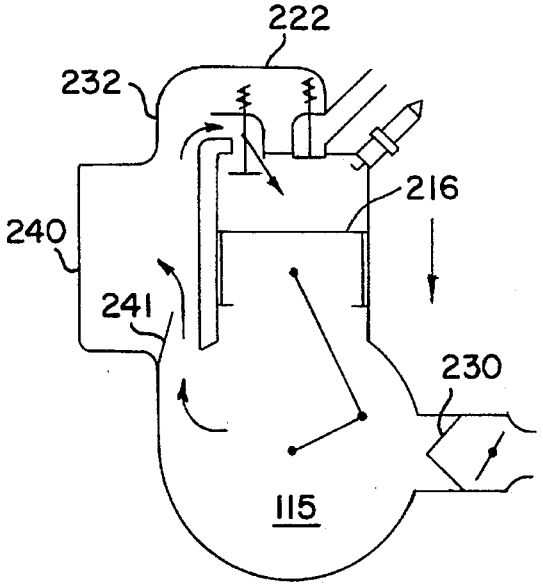

The engine 210 operates similarly to the previously described engine, with the exception that the volume of the mixture in the plenum 240 will have a higher pressure than that of the mixture in the duct 132. This is true because, with reference to FIGS. 2A and 2B, as the piston 216 moves upwardly in the compression stroke, the mixture is drawn into the crankcase chamber 115 from the carburetor and the check valve 241 is closed. During the power stroke shown in FIG. 2B, the piston 216 moves downwardly and the inlet valve 230 closes, and consequently the piston forces the mixture into the plenum 240 and it is compressed. The mixture is trapped by the closed valves 219 and 241 in the plenum chamber during the exhaust stroke shown in FIG. 2C and during the next subsequent intake stroke when the piston moves downwardly again as shown in FIG. 2D, additional mixture is pumped into the plenum and the valve 219 opens. The pressure in the plenum at the end of the intake stroke is increased and is a function of the crankcase chamber 115 volume, the volume of the plenum 240 and the displacement of the piston 216, and it may be approximately 8 to 15% above ambient pressure, for example. This increased pressure or supercharging, of course, improves the volumetric efficiency of the engine and allows the engine to produce greater power for a given size than would otherwise be the case.

In addition, the increased pressure creates a denser or more concentrated mixture, resulting in an increased amount of lubricant flowing past and surrounding the parts, thereby increasing the efficiency of lubrication.

Figure 3A:
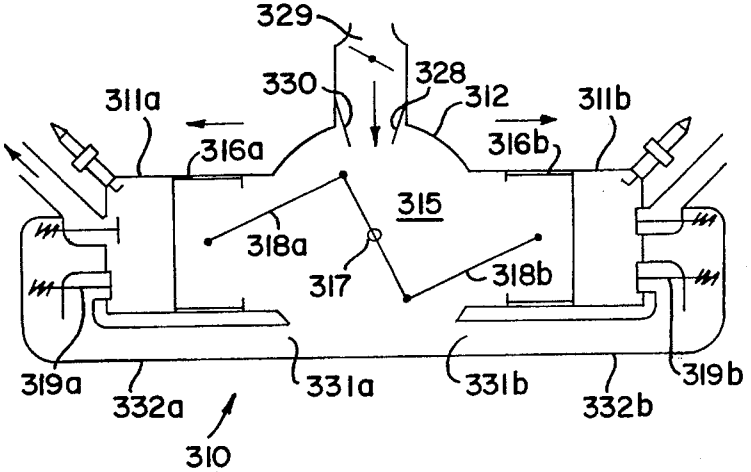
FIGS. 3A and 3B are similar to FIGS. 1C and 1D but illustrate still another alternative construction of the invention.
Figure 3B:
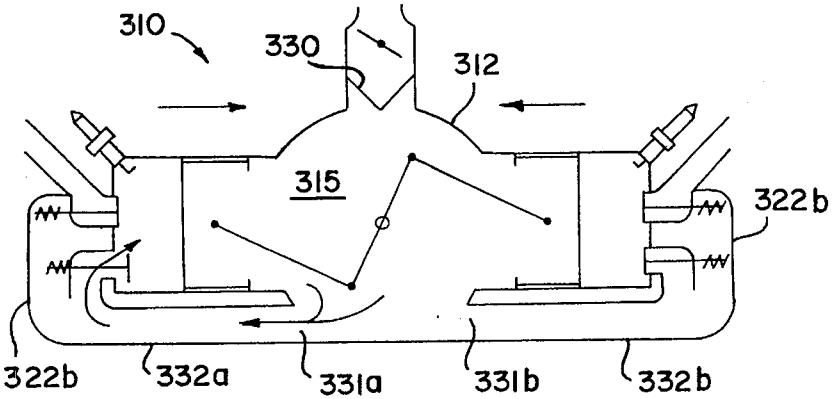

FIGS. 3A and 3B illustrate an engine 310 having a pair of cylinders, but otherwise constructed similarly to the engine illustrated in FIGS. 1A through 1D. The two cylinders have pistons which reciprocate in synchronism such that they simultaneously move toward the crankcase or toward the cylinder head. In the present specific example, one pair of cylinders is shown although multiple pairs may be provided. While opposed cylinders are illustrated and described herein, the cylinders could instead be parallel or in a V configuration, for example. The engine 310 includes a crankcase 312 having an inlet port 328 covered by a check valve 330, the port 328 connecting the crankcase chamber 315 with a carburetor 329. The crankcase further has two outlet ports 331*a* and 331*b* connected with two ducts 332*a* and 332*b*.

The engine further includes two opposed cylinders 311*a* and 311*b*, and pistons 316*a* and 316*b* mounted for reciprocation with the cylinders. The two pistons are connected by connecting rods 318*a* and 318*b* to a crankshaft 317, the connections being arranged such that the two pistons simultaneously move toward each other and then away from each other in the operating cycles of the engine. The firing order of the two pistons is, however, reversed so that when the piston 316*a* is moving outwardly in the exhaust stroke (FIG. 3A) the piston 316*b* is moving outwardly in the compression stroke, and when the piston 316*a* is moving inwardly in the intake stroke (FIG. 3B), the other piston 316*b* is moving inwardly in the power or expansion stroke. Each cylinder further includes intake and exhaust valves, a valve operating mechanism (not shown), such as one of the previously discussed types, and a spark plug mounted in a head portion of the engine frame, the construction and operation of these parts being generally the same as that of the engine shown in FIGS. 1A to 1D. Simultaneous outward movement of the pistons as shown in FIG. 3A causes the mixture to be drawn from the carburetor 329 and into the crankcase chamber 315, and simultaneous inward movement of the two pistons causes the mixture to be pumped from the chamber 315 through one of the two ducts 332*a* and 332*b* and one of the intake valves 319*a* and 319*b*.

Figure 4A:
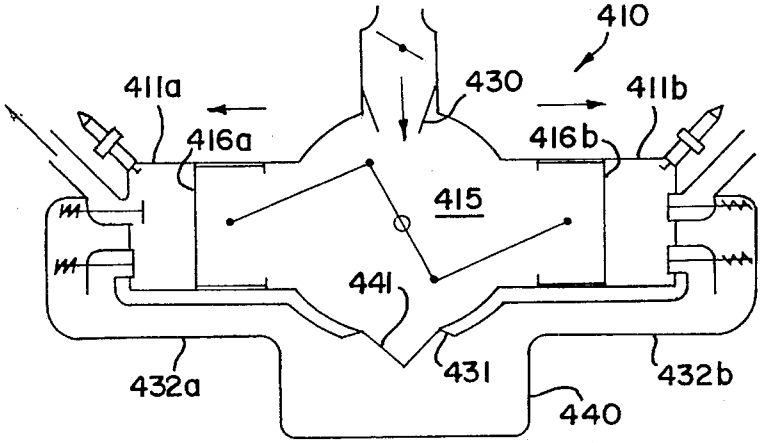
FIGS. 4A and 4B are similar to FIGS. 3A and 3B but illustrate still another alternative construction of the invention.
Figure 4B:
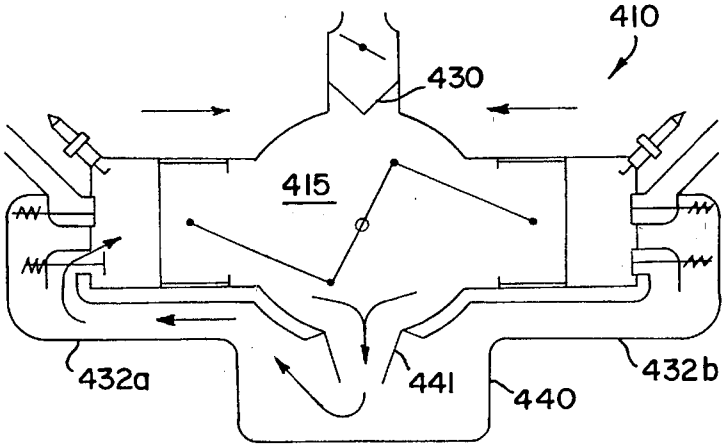
Figure 5A:
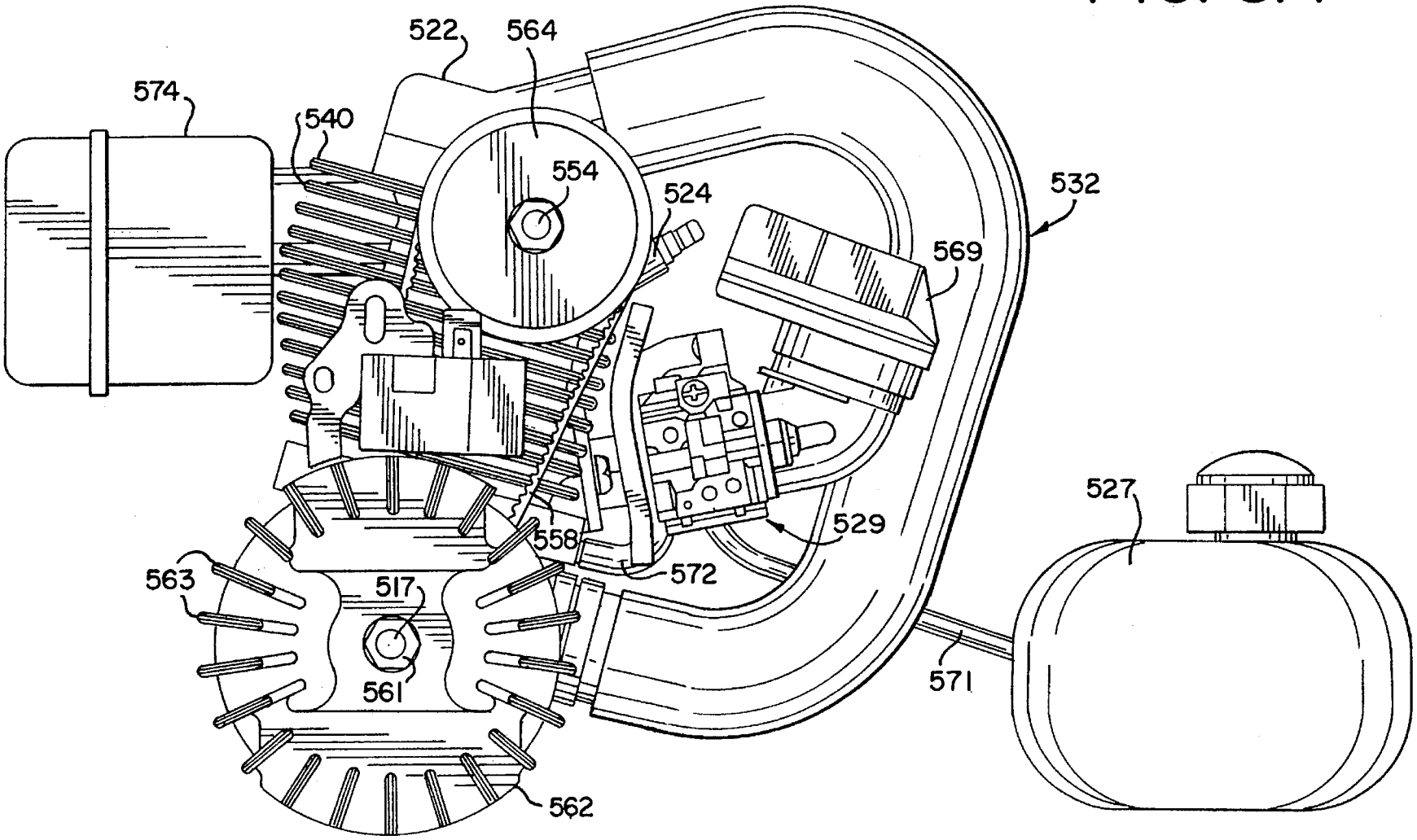
FIG. 5A further illustrates an engine constructed in accordance with the invention.
Figure 5B:
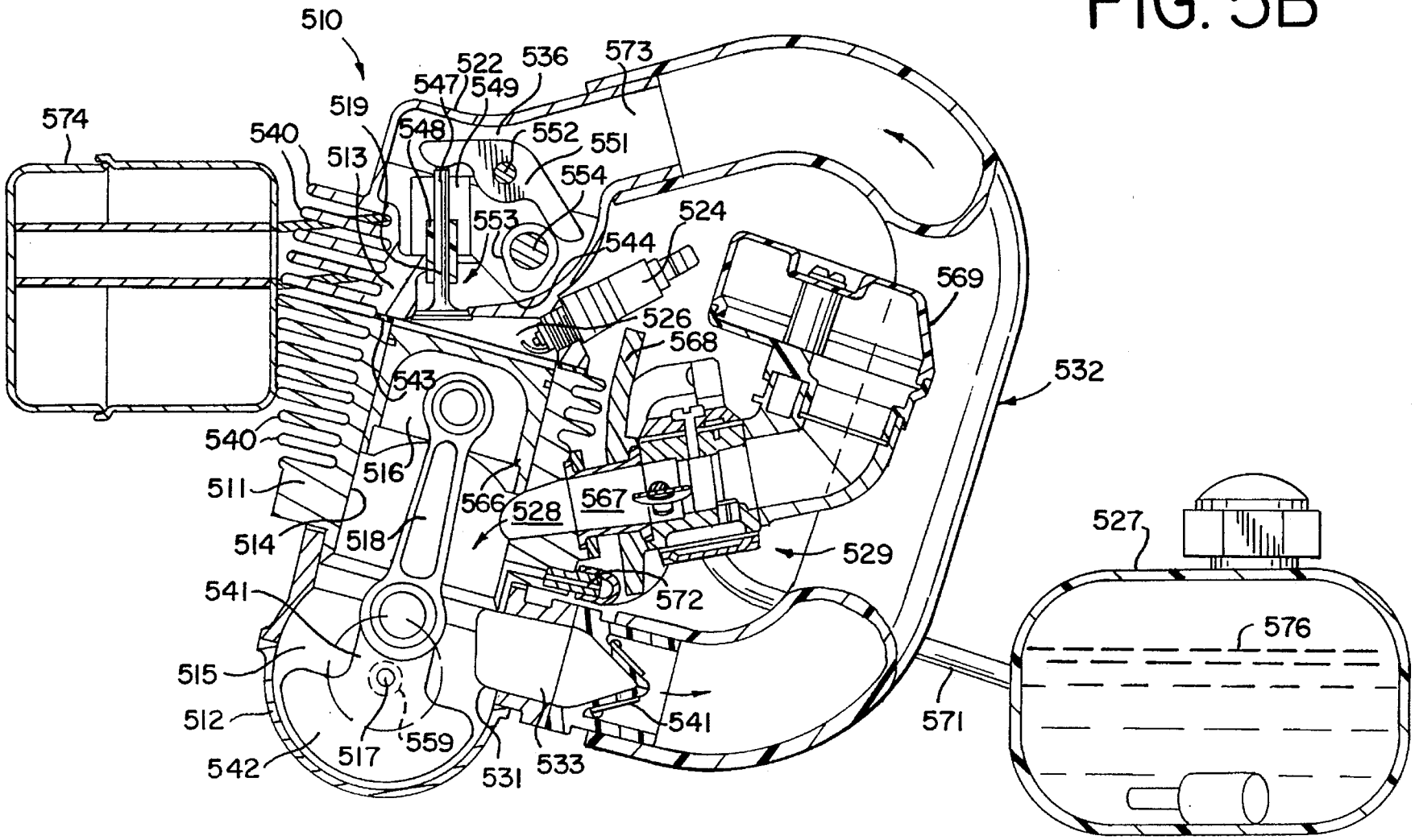
FIG. 5B shows the engine of FIG. 5A but with some parts broken away to show underlying parts.

FIGS. 4A and 4B illustrate an engine 410 having two opposed cylinders 411*a* and 411*b* and two pistons 416*a* and 416*b*, similar to the engine 310. The engine 410 further includes a plenum 440 and an outlet check valve 441 which are common to the two cylinders and feed the mixture received from the crankcase chamber 415 to the two ducts 432*a* and 432*b*. Thus the engines 310 and 410 operate similarly except that the supercharged pressure in the intake ducts (as described in connection with the engine shown in FIG. 2A) will be higher, giving the engine 410 higher efficiency. The supercharged pressure in the plenum 440 will, however, be higher than that in the plenum 240 because the total volume swept by the two pistons is twice the displacement of one cylinder while the volume to be filled (one combustion chamber) for each revolution equals the displacement of one cylinder. The pressure at the end of the intake stroke may be about 16–25% above ambient pressure in a two-cylinder engine without a plenum (or surge tank) as shown in FIGS. 3A and 3B, and may be about 21–45% above ambient in an engine with a plenum as shown in FIGS. 4A and 4B.

FIGS. 5A and 5B illustrate another engine 510 constructed according to the invention, and again the same reference numerals used in FIGS. 1A to 1D are used for corresponding parts, but in the 500 series. With particular reference to FIG. 5B, the engine frame includes a block 511, a crankcase 512 and a head 513 which also forms a valve cover 522. In this specific example, the engine is air-cooled, and cooling fins 540 are formed on the outside of the block 511 and the head 513.

A piston 516 is mounted for reciprocation in the cylinder 514, and the piston is connected by a connecting rod 518 to the crankshaft 517 in the customary manner. A crank arm 541 is mounted on the crankshaft 517 and connects to the rod 518, and the arm 541 includes a counterbalance portion 542. As shown in FIG. 5B, the chamber 515 of the crankcase 512 is relatively small and closely confines the crankshaft 517 and the crank arm 541, this being made possible because the case 512 is not also required to form a sump for a lubricating oil. The block 511 and the crankcase 512 are tightly connected together and form the interior chamber 515 which is sealed except for inlet and outlet ports 528 and 531 to be described.

A combustion chamber 526 is formed between the crown of the piston 516, the wall of the cylinder 514 and the inside of the head 513. A head gasket 543 between the block 511 and the head 513 seals the connection between them. The inside of the head 513 forms a wall 544 across the upper (as seen in FIG. 5B, although the engine could have other orientations) side of the cylinder 514. Formed in the wall 544 are an intake port, an exhaust port (not shown) and an opening for the spark plug 524. An intake valve 519 and an exhaust valve (not shown) are mounted to open and close the respective ports in the conventional manner for a four-stroke engine. Each valve includes a valve stem 547 that is slidably mounted in a valve guide 548, and a valve spring 549 urges the valve upwardly toward the closed position.

The engine further includes a valve actuating or driving mechanism including a rocker arm 551 pivotably mounted on a rocker shaft 552. One end of each arm 551 engages the outer end of a valve, and the other end engages a valve cam 553 secured to a cam shaft 554. This arrangement forms a conventional overhead-valve, overhead-cam arrangement which is contained in the enclosure 536 formed by the valve cover portion 522 of the head.

With reference to FIG. 5A, a cogged timing belt 558 is provided to rotate the cam shaft 554, and is driven by a drive sprocket (not shown) mounted on the crankshaft 517. The crankshaft 517 is supported by at least one bearing 559 (FIG. 5B) on the block 511 and the crankcase 512. In the specific example of the engine shown in FIGS. 5A and 5B, both ends of the shaft 517 extend out of the block, and the end not shown in the drawings is shaped to be attached to a tool or implement to be driven. The other end, shown in FIG. 5A, is secured by a nut 561 to a wheel 562 that forms a flywheel and a fan. Fins or vanes 563 are provided on the wheel 562 and cause cooling air to circulate around the fins 540. The abovementioned drive sprocket is also driven by the shaft 517 and may form part of the wheel 562. The belt 558 also meshes with a driven sprocket 564 which is secured to one end of the cam shaft 554. The sprocket ratio is such that the cam shaft 554 makes one revolution for two revolutions (one operating cycle) of the crank shaft 517. The cam shaft 554 is rotatably supported by bearings (not shown) on the head 513. Both the bearings for the camshaft and the bearings for the crankshaft are accessible from within the enclosure 536 and the chamber 515 for lubrication purposes, as will be described more fully hereinafter.

As previously mentioned, an inlet port 528 and an outlet port 531 are formed in the block 511. The inlet port 528 is located in the sidewall of the cylinder 514 at the location when the port is open when the piston 516 is at the top-dead-center (TDC) position, which is illustrated in FIG. 5B. As the piston 516 moves toward the bottom-dead-center (BDC) position (not illustrated), the skirt 566 of the piston gradually covers and then closes the port 528 twice in each operating cycle.

The carburetor 529 is connected to the inlet port 528 by a tube 567 and it is supported by a brace 568 that is fastened to the block. The air intake of the carburetor 529 is connected to an air cleaner 569, and the fuel intake is connected to the fuel supply tank 527 by a tube 571. The carburetor 529 may be a conventional diaphragm type, and the tank 527 and the air cleaner 569 may also be conventional. A passage 572 connects the crankcase chamber 515 to the carburetor 529 for pumping fuel to the carburetor, in a conventional manner.

The outlet port 531 is connected to the duct 532 by a tube 533 and a one-way valve 541. In the present example, the valve 541 is a reed valve type which allows flow only in the direction toward the duct 532.

The duct 532 may be made, for example, of plastic or other flexible material, and it has one end connected to the valve 541 outlet and its other end connected to a port 573 formed on the valve cover 522. The duct 532 is generally U-shaped and extends clear of and separate from the block 511. As shown in FIG. 5B, the port 573 communicates directly with the valve cover enclosure 536 and with the valve port in the head 513 for the intake valve 519.

The port in the head 513 for the exhaust valve (not shown in FIGS. 5A and 5B) is similar to the corresponding parts of the engines 110, 210, 310 and 410, where it will be noted that the exhaust duct 123, for example, is closed off from the enclosure 136. Consequently the exhaust does not enter the enclosure 536 but instead flows through the exhaust duct to a muffler 574. The valve guides 548 and the valve springs 549 of both the intake and exhaust valves are open or accessible to the flow of the air-gas-oil mixture in the enclosure 536 for lubrication purposes.

Considering the operation of the engine 510, the operator pours a quantity 576 of fuel-oil (such as a 40:1 mix of gasoline and oil commonly used for two-stroke engines) into the tank 527. The mix is drawn into the carburetor 529 through the tube 571, and mixed with air to form a combustible mixture. The gasoline vaporizes and the oil forms a very fine mist.

When the piston 516 moves toward TDC, the volume of the crankcase chamber 515 increases, causing the pressure in the enclosure 515 to drop, and the piston skirt 566 moves to the illustrated position and the inlet port 528 is opened. The mixture is drawn into the chamber 515 from the carburetor 529 and the reduced pressure in the enclosure 515 closes the outlet valve 541. This occurs during both the compression and exhaust strokes.

When the piston 516 moves from TDC toward BDC, the piston skirt closes the inlet port 528 and the moving piston reduces the volume of the crankcase chamber 515. The resulting compression of the mixture in the chamber 515 opens the valve 541 and forces the mixture into the duct 532. In the power stroke, the mixture in the duct 532 is compressed because the intake valve 519 is closed, and the increased pressure in the duct is held or retained when the reed valve 541 closes at the time the piston moves up again. In the intake stroke, the compressed mixture is drawn into the cylinder and additional mixture is forced into the duct by the piston. Thus the crankcase compression acts as a supercharger and makes possible an increase in power output for a given size engine. The compression also increases the density of the oil mist and improves the lubrication of the parts.

As previously mentioned, a gasoline-oil-air mixture flows through the crankcase chamber 515, the duct 532 and the enclosure 536 of the valve cover 522. The mixture forms an oil mist in the chamber 515 and the enclosure 536 which flows past and surrounds and lubricates all of the parts requiring lubrication. Since there are four strokes in each operating cycle, and since the mixture leaves the enclosure 536 in only one stroke (the air intake stroke), the oil mist is relatively stationary in the chamber 515 and the enclosure 536. The chamber 515 and the enclosure 536 contain a sizeable quantity of the oil mist which surrounds and collects on the moving parts, thereby lubricating the parts without the use of an oil sump or grease packed around the parts.

The engine 510 is further advantageous in that the relatively large internal volume of the duct 532 functions similarly to a plenum or surge tank. The large volume of the duct is due to the U-shaped bend of the duct. The location of the port 528 and the piston 516 which closes and opens the port is also advantageous because it avoids the need for a separate check valve, and this arrangement also allows for an advantageous placement and location of the carburetor. This is particularly important in engines for small hand-held implements such as chain saws. Any blow-by gas past the piston flows into the crankcase chamber 515 and is returned to the combustion chamber.

Figure 6A:
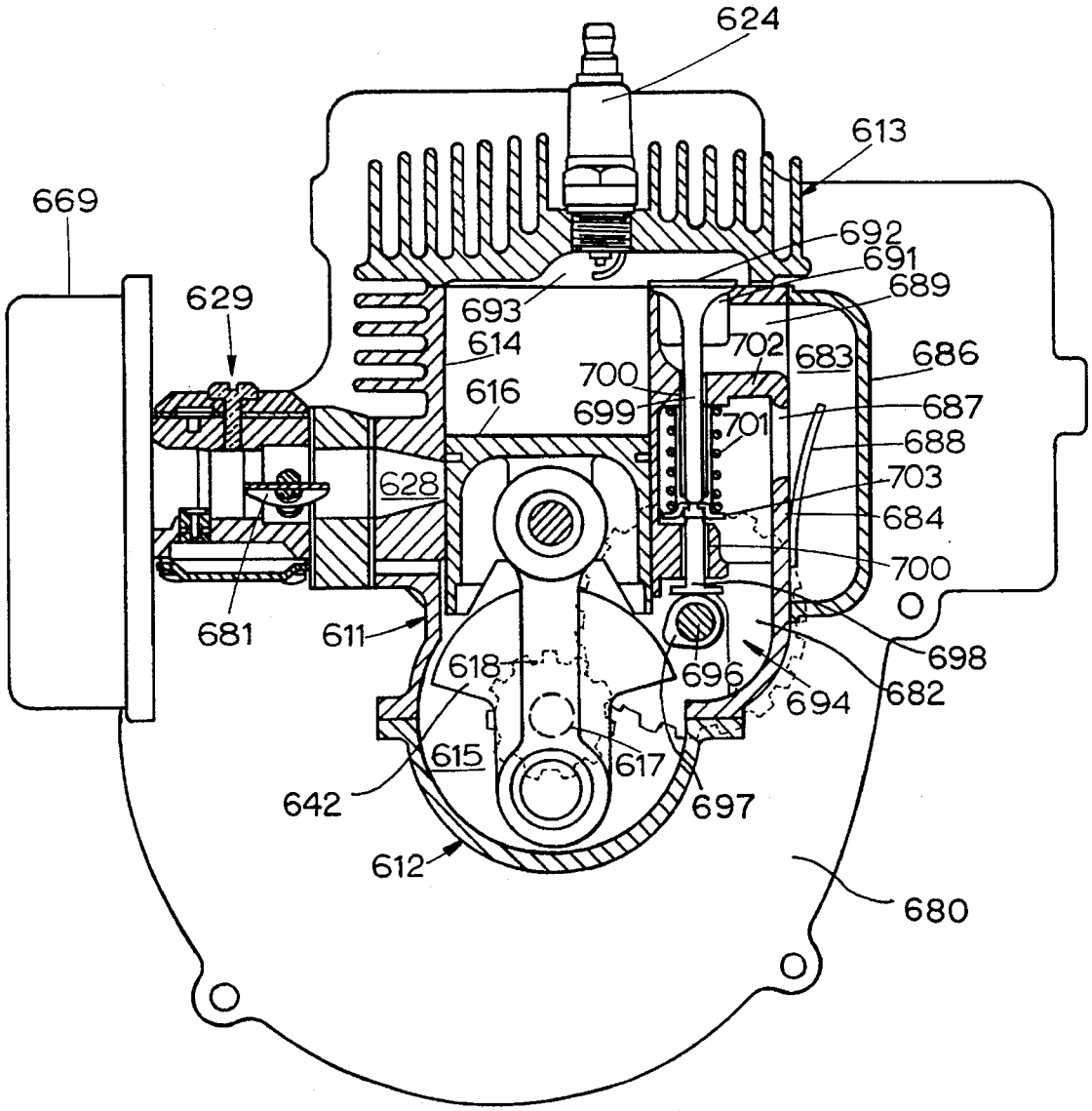
FIG. 6A is a view, partially in section, of another engine constructed in accordance with the invention.
Figure 6B:
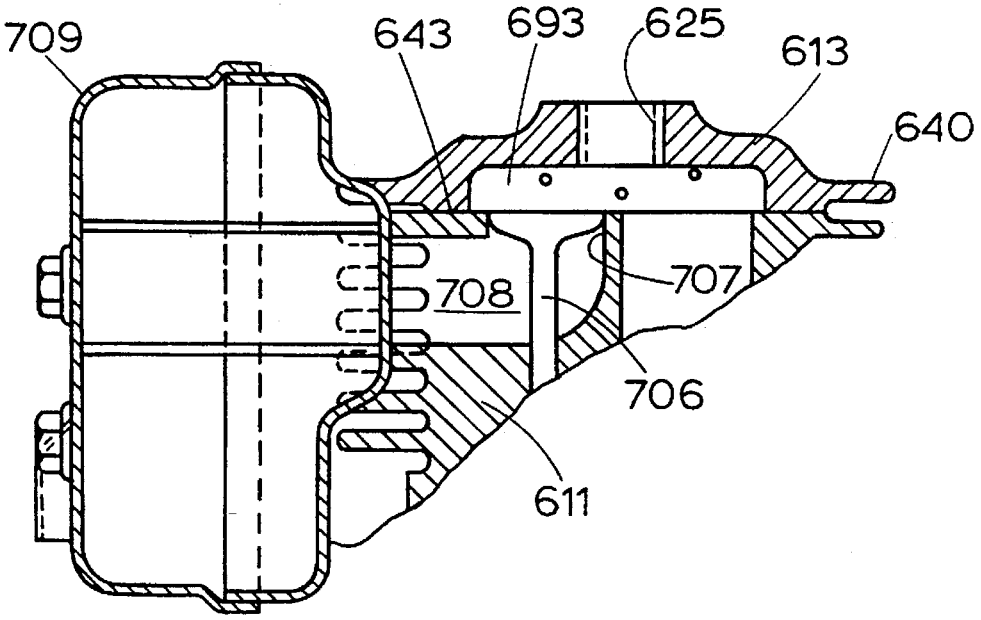
FIGS. 6B and 6C are additional views of the engine shown in FIG. 6A.
Figure 6C:
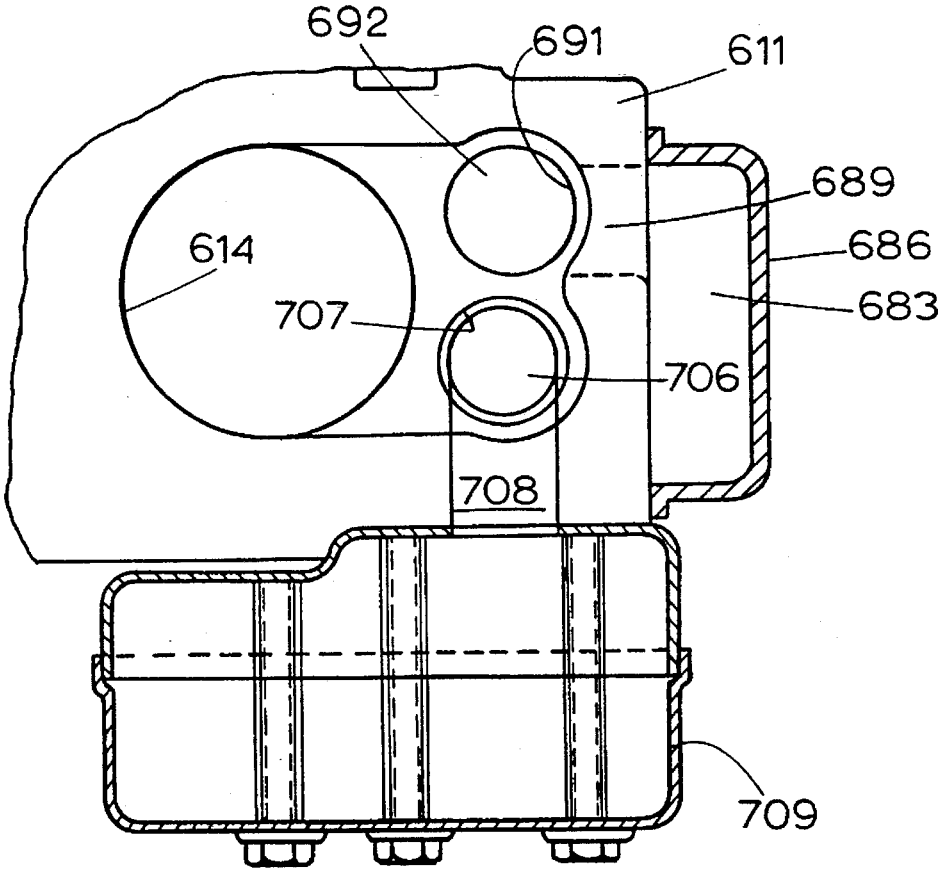

FIGS. 6A, 6B and 6C illustrate an engine which is generally similar to the engine shown in FIGS. 5A and 5B but which has a different head construction and a different valve and valve actuating mechanism.

The engine frame includes a block 611, a crankcase or pan 612, and a head 613. In this instance, the head 613 has an "L" head (or flat head) design, and a gasket 643 is between the head and the block. Both the head 613 and the block 611 have air cooling fins 640 on the outside. The block 611 is fastened to a mounting flange 680 which is provided for mounting the engine on a portable tool or implement.

A piston 616 is mounted in a cylinder 614, and a connecting rod 618 connects the piston 616 to a crankshaft 617. A counterbalance 642 is also connected to the crankshaft, and these parts rotate in the crankcase chamber 615. A sparkplug 624 is mounted in a hole 625 in the head 613.

The engine further includes a conventional carburetor 629 which preferably is an all-position type such as a diaphragm carburetor as illustrated in FIG. 6A. The carburetor includes a manually adjustable throttle 681 for controlling engine speed, and it receives air through a conventional air cleaner 669. A fuel (such as gasoline) supply tank (not illustrated) similar to the tank 527 is provided, and it forms a source of a fuel-oil mixture as previously described.

The carburetor 629 forms a combustible mixture of air-fuel-lubricating oil, the oil being in the form of a fine mist or droplets. As in the previously described embodiments, the mixture flows through the crankcase and a plenum chamber or surge tank to the combustion chamber, and the mixture effectively lubricates the engine parts requiring lubrication.

The mixture flows from the carburetor 629 and into the crankcase chamber 615 through an inlet port 628 formed in the sidewall of the cylinder. The port 628 is at a lower part of the cylinder wall and is covered by the skirt of the piston 616 except when the piston is near top-dead-center, as described in connection with the engine shown in FIG. 5B.

The mixture is pumped and compressed by the movement of the piston and it flows through a chamber 682 formed in the block to a plenum chamber or surge tank 683. The chamber 683 has one side 684 formed by the block 611 and an outer side formed by a cover 686 which is secured to a side of the block (see FIGS. 6A and 6C). A port 687 and a check valve 688 allow flow only in the direction from the chamber 682 to the chamber 683. The plenum chamber 683 includes a portion 689 formed in the block, the portion 689 leading to a port 691 of an air intake valve 692. The upper side (as seen in FIG. 6A) of the valve port 691 leads to a cavity 693 formed in the underside of the head 613, the cavity 693 forming part of the combustion chamber.

Mounted in the chamber 682 is an actuating mechanism 694 for the valve 692. The mechanism 694 includes a cam shaft 696 rotatably mounted on the block 611 and having a gear connection with the crankshaft 617. The cam shaft 696 includes a cam 697 that engages one end of a follower and push rod 698. The other end of the push rod 698 engages the lower end (as seen in FIG. 6A) of the stem 699 of the valve 692. The push rod 698 and the stem 699 are slideably mounted in bearings 700 mounted on the block. A compression return spring 701 positioned between a ledge 702 of the block and a clip 703 on the valve 699, and the spring 701 holds the rod 698 against the cam 697 and urges the valve 692 to the closed position.

The engine shown in FIGS. 6A to 6C further includes an exhaust valve 706 (FIGS. 6B and 6C) movably mounted in an exhaust port 707 formed in the block adjacent the cylinder 614 and the intake port 691. The exhaust valve 706 is operated by a valve actuating mechanism (not illustrated) constructed and located similarly to the actuating mechanism for the intake valve 692. The cam shaft 696 supports a second cam (not shown) similar to but angularly offset from the cam 697, of the actuating mechanism for the valve 706, and the stem of the valve 706 is movably mounted on the block 611. When the valve 706 is open, exhaust gases flow from the cylinder 614 and the head cavity 693, through the open exhaust port 707, through an exhaust flow passage 08 formed in the block 611, and to a muffler 709 mounted on the side of the block.

The engine design shown in FIGS. 6A to 6C is especially advantageous because all of the engine parts requiring lubrication are located in the crankcase chambers 615 and 682. The rotating parts attached to the crankshaft and the movement of the piston cause turbulence of the fuel-oil-air mixture in the crankcase chambers, and the turbulence ensures that there is adequate flow of the mixture around the parts requiring lubrication. Thus the parts are more effectively lubricated than would be the case if some of the parts were in the plenum or in the head. Further, the engine shown in FIGS. 6A and 6B has a compact design.

In a single cylinder engine having a storage plenum or surge tank, as illustrated in FIGS. 2A–2D, FIG. 5A and FIG. 5B and FIGS. 6A to 6C, for example, the volume of the surge tank and the volume of the crankcase have a considerable effect on the gas pressure in the cylinder at the start of the compression stroke. For a single cylinder engine, assuming that the gas transformation is isothermal, then:

$$Pc = \frac{Po\,(V + Vc)}{Vc} \tag{1}$$

$$Pt = \frac{Pc \cdot Vc + Pa \cdot Vt}{Vt + Vc} \tag{2}$$

$$Pa = \frac{Pt \cdot Vt}{Vt + Vc + V + Vcc} + \frac{Pc \cdot Vc}{V + Vc + Vt + Vcc} \tag{3}$$

where:

Po is the ambient pressure.

Pa is the pressure in the cylinder at the bottom dead center before the compression stroke.

Pt is the maximum pressure in the surge tank at the bottom dead center.

Pc is the maximum theoretical pressure in the crankcase at the bottom dead center.

V is the total engine displacement.

Vc is the crankcase clearance volume.

Vt is the surge tank volume.

Vcc is the cylinder clearance volume.

For a two cylinder engine having a surge tank (such as shown in FIGS. 4A and 4B), again assuming an isothermal gas transformation, then:

$$Pc = \frac{Po\,(V + Vc)}{Vc} \quad (4)$$

$$Pt = \frac{Pc \cdot Vc + Pa \cdot Vt}{Vt + Vc} \quad (5)$$

$$Pa = \frac{Pt \cdot Vt}{Vt + Vc + V/2 + Vcc} + \frac{Pc \cdot Vc}{V/2 + Vc + Vt + Vcc} \quad (6)$$

The pressure Pa stabilizes after a few revolutions of the engine.

It will be apparent from the foregoing that an improved four-stroke engine is described. The moving parts of the engine are lubricated by the fuel-oil-air mixture, which arrangement avoids the need for a separate lubrication system. The mixture is supercharged without the need for a separate supercharger. Since it is a four-stroke engine, the emissions are relatively clean despite the presence of the oil in the mixture.

What is claimed is:

1. A four-stroke internal-combustion engine for operation with a combustible mixture of air, fuel and lubricating oil, comprising:

a) an engine frame comprising a block portion and a head portion forming a cylinder and a crankcase chamber;

b) a crankshaft rotatably mounted in said crankcase chamber, and a piston mounted for reciprocation in said cylinder, a rod connecting said piston with said crankshaft, said cylinder, said head portion and said piston forming a combustion chamber;

c) said engine further including an intake valve, an exhaust valve, and an actuating mechanism for said valves, said actuating mechanism operating in synchronism with said piston and opening said intake valve during an intake stroke of said piston and opening said exhaust valve during an exhaust stroke of said piston;

(d) a carburetor for creating a combustible mixture of fuel, air and an oil mist;

(e) a duct connecting said crankcase chamber with said intake valve; and (f) said carburetor, said crankcase chamber, said duct, and said intake valve forming a flow path for said mixture from said carburetor to said combustion chamber, said crankshaft, said rod, and said actuating mechanism being located in said flow path and being lubricated by said oil mist.

2. An engine as set forth in claim 1, and further including a first one-way valve between said carburetor and said crankcase and enabling flow of said mixture in the direction of said crankcase.

3. An engine as set forth in claim 2, and further including a second one-way valve between said crankcase and said duct and enabling flow of said mixture only in the direction of said duct.

4. An engine as set forth in any one of claims 1, 2 or 3, wherein said first and said second one-way valves and said actuating mechanism are mounted on said block portion.

5. An engine as set forth in any one of claims 1, 2 or 3, wherein said head portion has a cavity formed therein and said flow path includes said cavity, and said intake and exhaust valves and said actuating mechanism are mounted in said cavity.

6. An engine as set forth in any one of claims 1, 2 or 3, wherein said carburetor is an all-position type, and said engine is relatively small, lightweight and portable.

7. An engine as set forth in claim 3, wherein said duct forms a surge tank.

8. An engine as set forth in claim 4, wherein said actuating mechanism comprises a cam shaft rotatably mounted in said crankcase chamber, and further including gears connecting said cam shaft with said crankshaft.

9. An engine as set forth in claim 5, wherein said actuating mechanism comprises a cam shaft rotatably mounted in said head, and further including a belt connecting said cam shaft with said crankshaft.

10. An engine as set forth in claim 7, wherein said duct has one side thereof formed by a side of said block portion and another side thereof formed by a cover fastened to said side of said block portion.

11. An engine as set forth in claim 7, wherein said duct is U-shaped and is spaced from said block portion.

12. An engine as set forth in claim 1, and further including a second engine frame, a second piston connected to said crankshaft, and second intake and exhaust valves and valve actuating mechanism, said carburetor, said crankcase and said duct being common to both of said engines.

13. An engine as set forth in claim 2, wherein said first one-way valve comprises a port in said cylinder and a skirt portion of said piston, said skirt portion opening and closing said port.

14. An engine as set forth in claim 2, wherein said first one-way valve comprises a port in said engine frame between said carburetor and said crankcase chamber, and a one-way flow valve in said port.

15. A multiple cylinder four-stroke engine fueled by a combustible mixture of fuel, oil and air, said engine comprising:

a) an engine frame forming a crankcase chamber and first and second cylinders;

b) first and second pistons mounted for reciprocation in said first and second cylinders respectively and forming with said frame first and second combustion chambers, said first and second pistons moving simultaneously toward or away from said crankcase chamber whereby said crankcase chamber has a volume which alternately increases and decreases with said reciprocation of said pistons;

c) said frame further forming first and second valve enclosures adjacent said first and second combustion chambers, and said engine further including first and second valve mechanisms mounted in said first and second valve enclosures, respectively;

d) each of said valve mechanisms comprising a fuel intake valve and an exhaust valve and a valve actuating mechanism;

e) said frame further including at least one inlet port leading to said crankcase chamber and at least one outlet port leading out of said crankcase chamber, said at least one inlet port being connectable to receive said mixture; and f) duct means connecting said at least one outlet port with said first and second valve enclosures and with said fuel intake valves, said mixture flowing through said crankcase chamber and said valve enclosures and lubricating the parts therein during engine operation.

16. An engine as set forth in claim 15, and further including a first one-way valve in said inlet port for permitting flow into said crankcase chamber.

17. An engine as set forth in claim 15, wherein said duct means forms a surge tank.

18. An engine as set forth in claim 17, and further including a second one-way valve in said outlet port for permitting flow out of said crankcase chamber.

19. An engine as set forth in claim 15, wherein said engine further comprises a crankshaft in said crankcase chamber and rotatably mounted on said frame, said first and second pistons being connected to said crankshaft, said engine having an operating cycle formed by two revolutions of said crankshaft, and said pistons having power strokes in alternate revolutions.

20. An engine as set forth in claim 19, wherein said cylinders are mounted in opposed relation and said pistons reciprocate toward and away from each other.

21. An engine as set forth in claim 15, wherein said crankcase chamber and said valve enclosures are shaped to flow sufficient quantities of said mixture around engine parts therein to lubricate said engine parts.

22. An engine as set forth in claim 15, wherein said duct means is U-shaped and has ends connected to said crankcase chamber and to said valve enclosure and a central portion which is separate and spaced from said frame.

* * * * *